US012655615B2

(12) United States Patent
Oasa et al.

(10) Patent No.: US 12,655,615 B2
(45) Date of Patent: Jun. 16, 2026

(54) METHOD FOR CALCULATING ANGLE OF REPOSE OF EXCAVATED OBJECT HELD BY BUCKET, SYSTEM FOR CALCULATING ANGLE OF REPOSE OF EXCAVATED OBJECT HELD BY BUCKET, AND LOADING MACHINE

(71) Applicant: Komatsu Ltd., Tokyo (JP)

(72) Inventors: Takahisa Oasa, Tokyo (JP); Shozo Kikuchi, Tokyo (JP); Ryota Kudo, Tokyo (JP); Yoshitaka Onodera, Tokyo (JP); Takehiro Komatsu, Tokyo (JP)

(73) Assignee: KOMATSU LTD., Tokyo (JP)

( * ) Notice: Subject to any disclaimer, the term of this patent is extended or adjusted under 35 U.S.C. 154(b) by 117 days.

(21) Appl. No.: 18/704,485

(22) PCT Filed: Dec. 12, 2022

(86) PCT No.: PCT/JP2022/045610

§ 371 (c)(1),
(2) Date: Apr. 25, 2024

(87) PCT Pub. No.: WO2023/112878

PCT Pub. Date: Jun. 22, 2023

(65) Prior Publication Data

US 2025/0237039 A1 Jul. 24, 2025

(30) Foreign Application Priority Data

Dec. 15, 2021 (JP) ..... 2021-203509

(51) Int. Cl.
*E02F 9/26* (2006.01)
*E02F 3/43* (2006.01)

(52) U.S. Cl.
CPC ..... *E02F 9/265* (2013.01); *E02F 3/435* (2013.01)

(58) Field of Classification Search
CPC . E02F 3/431; E02F 3/435; E02F 9/264; E02F 9/265
See application file for complete search history.

(56) References Cited

U.S. PATENT DOCUMENTS 6,552,279 B1 4/2003 Lueschow et al.
10,557,249 B2 2/2020 Tsuji
(Continued)

FOREIGN PATENT DOCUMENTS

EP 3744909 A1 12/2020
JP 2002-195870 A 7/2002
(Continued)

OTHER PUBLICATIONS

Supplementary European Search Report dated Aug. 14, 2025, issued in the corresponding EP patent application No. 22907402.6.

*Primary Examiner* — Tyler J Lee
(74) *Attorney, Agent, or Firm* — Troutman Pepper Locke LLP

(57) ABSTRACT

A method for calculating an angle of repose of an excavated object held by a bucket includes: calculating a bucket angle indicating an angle of the bucket with respect to a horizontal plane in a state where an inclination of a surface of the excavated object held by the bucket is maintained; measuring a weight of the excavated object; and calculating the angle of repose of the excavated object from shape data of the bucket, the bucket angle, and data of the excavated object including the measured weight.

8 Claims, 11 Drawing Sheets

(56) References Cited

U.S. PATENT DOCUMENTS

| | | | | |
|---|---|---|---|---|
| 11,062,061 | B2 * | 7/2021 | Martinsson | E02F 9/2029 |
| 2018/0239849 | A1 * | 8/2018 | Martinsson | E02F 3/40 |
| 2020/0385958 | A1 | 12/2020 | Seki et al. | |
| 2021/0272315 | A1 | 9/2021 | Kawamoto et al. | |

FOREIGN PATENT DOCUMENTS

| | | | |
|---|---|---|---|
| JP | 2019-178599 | A | 10/2019 |
| JP | 2019-203381 | A | 11/2019 |
| JP | 2020-034527 | A | 3/2020 |
| JP | 2020-165253 | A | 10/2020 |
| JP | 6915007 | B2 | 8/2021 |

* cited by examiner

METHOD FOR CALCULATING ANGLE OF REPOSE OF EXCAVATED OBJECT HELD BY BUCKET, SYSTEM FOR CALCULATING ANGLE OF REPOSE OF EXCAVATED OBJECT HELD BY BUCKET, AND LOADING MACHINE

FIELD

The present disclosure relates to a method for calculating an angle of repose of an excavated object held by a bucket, a system for calculating an angle of repose of an excavated object held by a bucket, and a loading machine.

BACKGROUND

In a technical field related to a loading machine including working equipment, a loading machine capable of obtaining the weight of a cargo material to be transferred as disclosed in Patent Literature 1 is known.

CITATION LIST

Patent Literature

Patent Literature 1: JP 2002-195870 A

SUMMARY

Technical Problem

In order to optimize a loading work of a loading machine, for example, it is desirable that the loading machine adjusts, when an excavated object excavated by working equipment is loaded onto a haul vehicle, the excavated object to an appropriate weight that is optimal for the haul vehicle. In this regard, the weight of the excavated object held by the working equipment can be predicted before excavation by using an angle of repose. Therefore, it is desirable to easily calculate the angle of repose.

An object of the present disclosure is to easily calculate an angle of repose.

Solution to Problem

According to an aspect of the present invention, a method for calculating an angle of repose of an excavated object held by a bucket, the method comprises: calculating a bucket angle indicating an angle of the bucket with respect to a horizontal plane in a state where an inclination of a surface of the excavated object held by the bucket is maintained; measuring a weight of the excavated object; and calculating the angle of repose of the excavated object from shape data of the bucket, the bucket angle, and data of the excavated object including the measured weight.

According to another aspect of the present invention, a system for calculating an angle of repose of an excavated object held by a bucket, the system comprises: a processor, wherein the processor calculates a bucket angle indicating an angle of the bucket with respect to a horizontal plane in a state where an inclination of a surface of the excavated object held by the bucket is maintained, measures a weight of the excavated object, and calculates the angle of repose of the excavated object from shape data of the bucket, the bucket angle, and data of the excavated object including the measured weight.

According to still another aspect of the present invention, a loading machine comprises: a bucket; and a processor, wherein the processor calculates a bucket angle indicating an angle of the bucket with respect to a horizontal plane in a state where an inclination of a surface of an excavated object held by the bucket is maintained, measures a weight of the excavated object, and calculates an angle of repose of the excavated object from shape data of the bucket, the bucket angle, and data of the excavated object including the measured weight.

Advantageous Effects of Invention

According to the present disclosure, it is possible to easily calculate an angle of repose.

DESCRIPTION OF EMBODIMENTS

Hereinafter, embodiments according to the present disclosure will be described with reference to the drawings, but the present disclosure is not limited the embodiments. Components of the embodiments to be described below can be combined as appropriate. In addition, some components are not used in some cases.

In the embodiments, a local coordinate system is set for a loading machine 1, and a positional relationship of each unit will be described using the local coordinate system. In the local coordinate system, a first axis along a left-right direction which is a vehicle width direction of the loading machine 1 is defined as an X axis, a second axis along a front-rear direction of the loading machine 1 is defined as a Y axis, and a third axis along a top-bottom direction of the loading machine 1 is defined as a Z axis. The X axis and the Y axis are orthogonal to each other. The Y axis and the Z axis are orthogonal to each other. The Z axis and the X axis are orthogonal to each other. A +X direction is a right direction, and a −X direction is a left direction. A +Y direction is a front direction, and a −Y direction is a rear direction. A +Z direction is a top direction, and a-Z direction is a bottom direction.

<Loading Machine>

Figure 1:
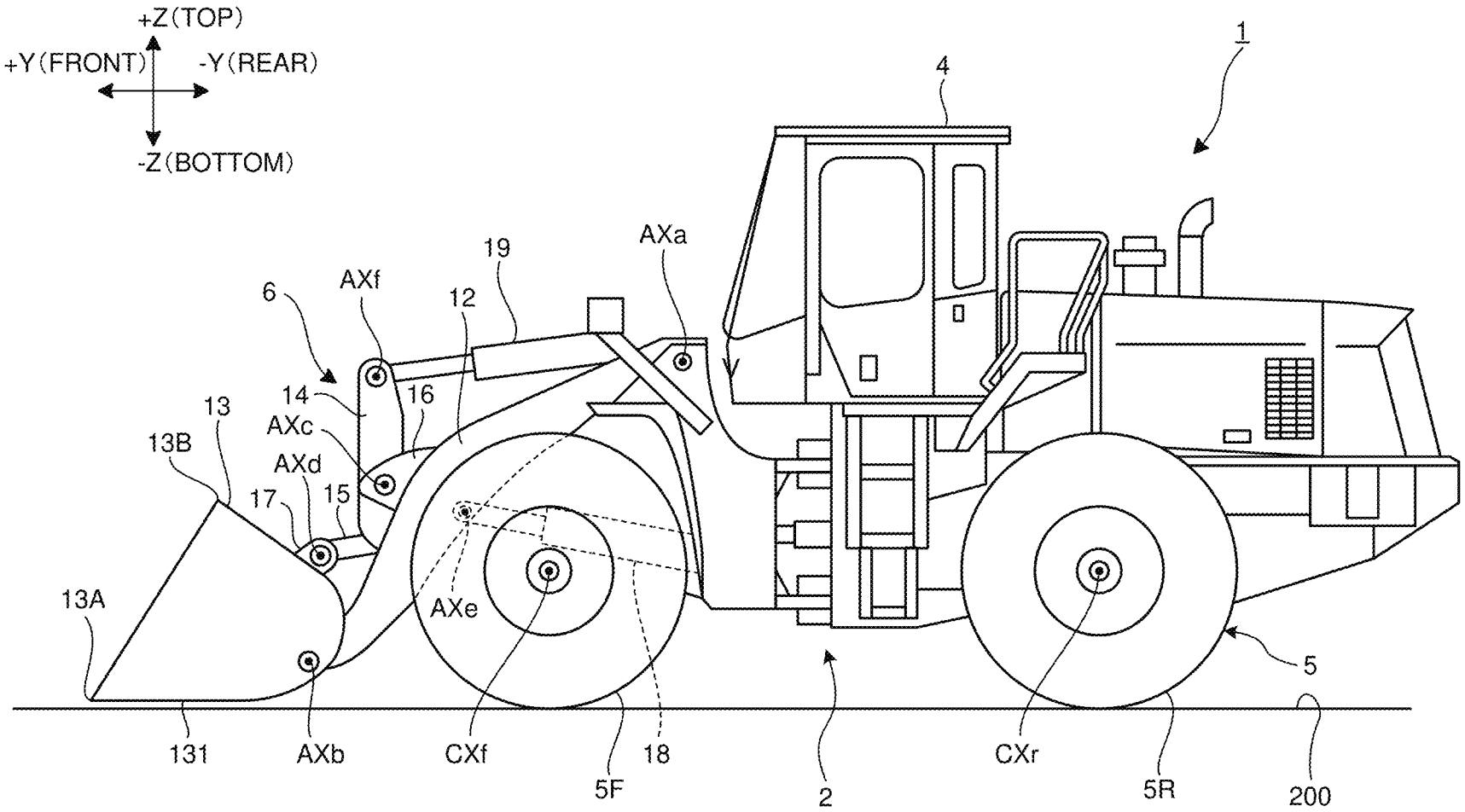
FIG. 1 is a side view illustrating a loading machine according to an embodiment.

FIG. 1 is a side view illustrating the loading machine 1 according to an embodiment. The loading machine 1 according to the embodiment is, for example, a wheel loader. In the following description, the loading machine 1 is referred to as a wheel loader 1 as appropriate. The wheel loader 1 includes a vehicle body 2, a cab 4, wheels 5, and working equipment 6.

The vehicle body 2 supports the working equipment 6. The cab 4 is supported by the vehicle body 2. In the embodiment, the cab 4 is disposed in an upper portion of the vehicle body 2. A working equipment operation device 24 described below is disposed inside the cab 4. The wheels 5 support the vehicle body 2. The wheels 5 include front wheels 5F and rear wheels 5R. FIG. 1 illustrates only the left front wheel 5F and the left rear wheel 5R.

The front wheel 5F is rotatable about a rotation 5 axis CXf. The rear wheel 5R is rotatable about a rotation axis CXr. When the wheel loader 1 travels straight, the rotation axis CXf of the front wheel 5F and the rotation axis CXr of the rear wheel 5R are parallel to each other. In the embodiment, the X axis is parallel to the rotation axis CXf of the front wheel 5F. The Z axis is orthogonal to a tread of the front wheel 5F in contact with a ground surface 200.

The working equipment 6 performs a predetermined work. The working equipment 6 is supported by the vehicle body 2. The working equipment 6 is connected to the vehicle body 2. The working equipment 6 includes a boom 12, a bucket 13, a bell crank 14, a bucket link 15, a lift cylinder 18, and a bucket cylinder 19.

A proximal end portion of the boom 12 is pivotably connected to the vehicle body 2. The boom 12 pivots about a pivot axis AXa with respect to the vehicle body 2. A bracket 16 is fixed to a middle portion of the boom 12.

A proximal end portion of the bucket 13 is pivotably connected to a distal end portion of the boom 12. The bucket 13 pivots about a pivot axis AXb with respect to the boom 12. The bucket 13 is disposed in front of the front wheel 5F. A bracket 17 is fixed to a part of the bucket 13.

A middle portion of the bell crank 14 is pivotably connected to the bracket 16. The bell crank 14 pivots about a pivot axis AXc with respect to the bracket 16. A lower end portion of the bell crank 14 is pivotably connected to a proximal end portion of the bucket link 15.

A distal end portion of the bucket link 15 is pivotably connected to the bracket 17. The bucket link 15 pivots about a pivot axis AXd with respect to the bracket 17. The bell crank 14 is connected to the bucket 13 via the bucket link 15.

The lift cylinder 18 operates the boom 12. A proximal end portion of the lift cylinder 18 is connected to the vehicle body 2. A distal end portion of the lift cylinder 18 is connected to the boom 12. The boom 12 pivots about a pivot axis AXe with respect to the lift cylinder 18.

The bucket cylinder 19 operates the bucket 13. A proximal end portion of the bucket cylinder 19 is connected to the vehicle body 2. A distal end portion of the bucket cylinder 19 is connected to an upper end portion of the bell crank 14. The bell crank 14 pivots about a pivot axis AXf with respect to the bucket cylinder 19.

Figure 2:
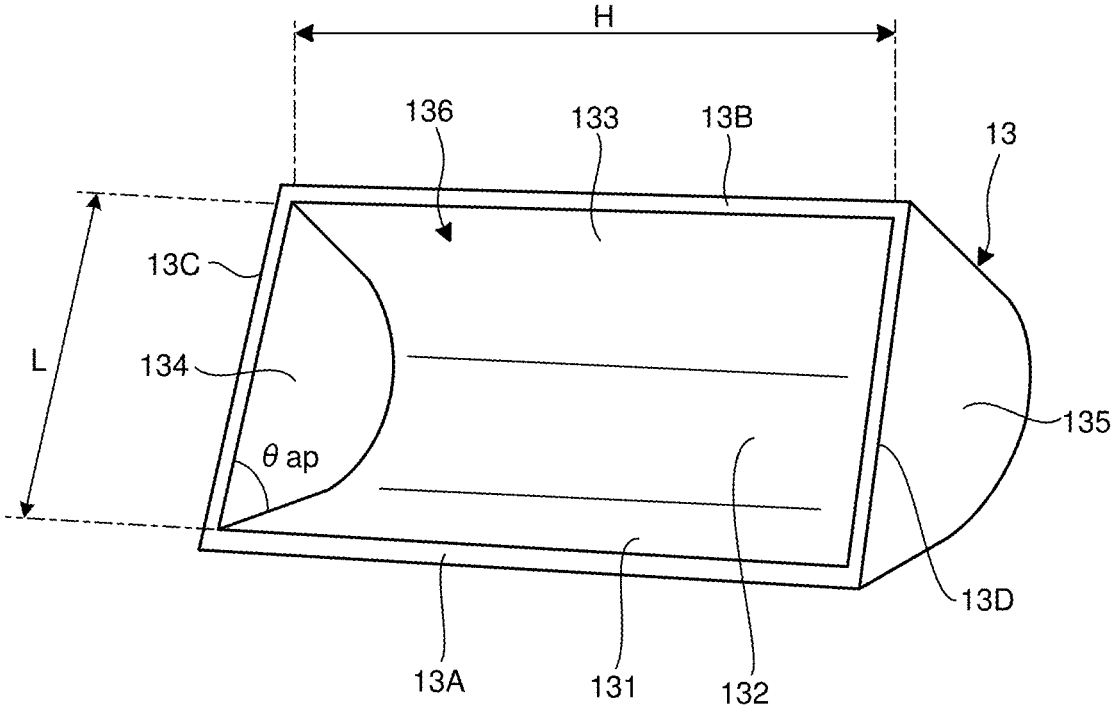
FIG. 2 is a perspective view illustrating a bucket according to the embodiment.
Figure 2:
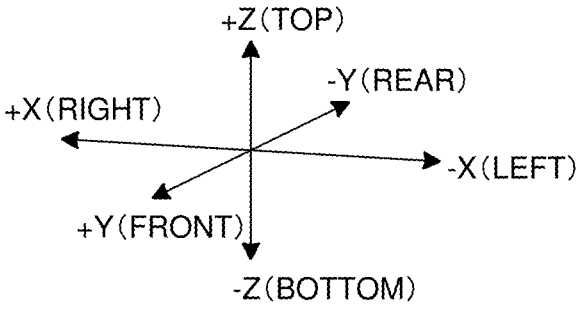
Figure 3:
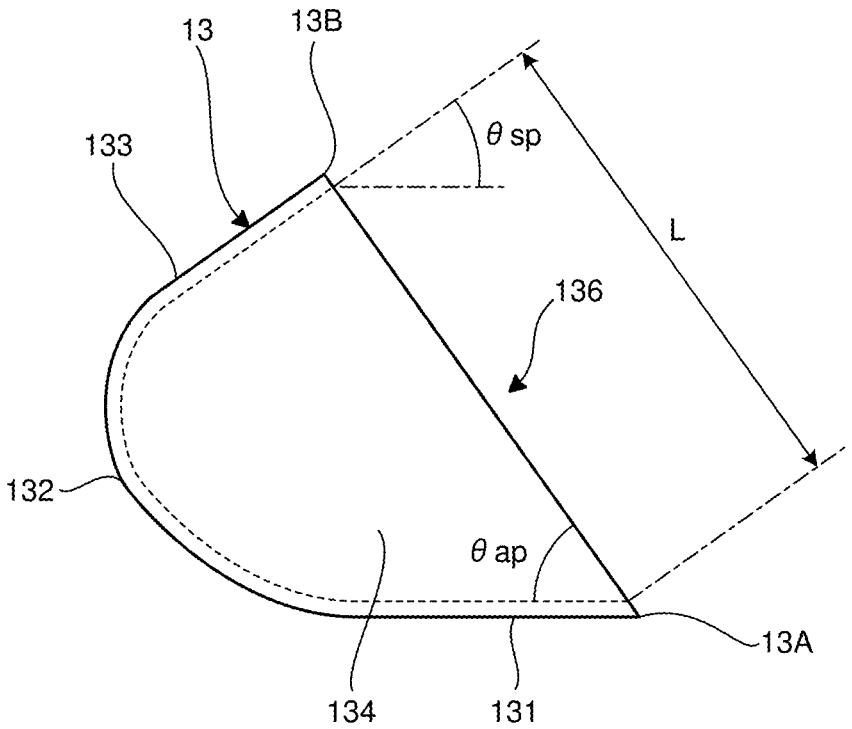
FIG. 3 is a side view schematically illustrating the bucket according to the embodiment.
Figure 3:
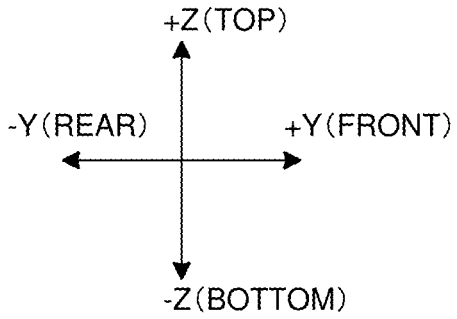

FIG. 2 is a perspective view illustrating the bucket 13 according to the embodiment. FIG. 3 is a side view schematically illustrating the bucket 13 according to the embodiment. The bucket 13 is a work member that excavates an excavation target. The bucket 13 holds the excavated excavation target. The bucket 13 includes a bottom plate portion 131, a back plate portion 132, an upper plate portion 133, a right plate portion 134, and a left plate portion 135. A blade end portion 13A is provided at a distal end portion of the bottom plate portion 131. A blade edge or a blade is attached to the blade end portion 13A. A distal end portion of the upper plate portion 133 is an upper end portion 13B. A distal end portion of the right plate portion 134 is a right end portion 13C. A distal end portion of the left plate portion 135 is a left end portion 13D. The blade end portion 13A extends in the left-right direction. The upper end portion 13B extends in the left-right direction. The right end portion 13C extends in the top-bottom direction or the front-rear direction. The left end portion 13D extends in the top-bottom direction or the front-rear direction. In the embodiment, the blade end portion 13A and the upper end portion 13B are parallel to each other. The right end portion 13C and the left end portion 13D are parallel to each other. An opening portion 136 of the bucket 13 is defined between the blade end portion 13A, the upper end portion 13B, the right end portion 13C, and the left end portion 13D. In other words, the opening portion 136 of the bucket 13 is defined by the blade end portion 13A, the upper end portion 13B, the right end portion 13C, and the left end portion 13D.

In the embodiment, a dimension of the opening portion 136 on a YZ plane, that is, a dimension of a straight line connecting the blade end portion 13A and the upper end portion 13B on the YZ plane is defined as a length L. The dimension of the opening portion 136 in the left-right direction is defined as a width H. A cross-sectional area of the bucket 13 on the YZ plane is Abk. An angle formed by an inner surface of the bottom plate portion 131 and the straight line connecting the blade end portion 13A and the upper end portion 13B on the YZ plane is defined as a blade side opening angle θap. An angle formed by the inner surface of the bottom plate portion 131 and an inner surface of the upper plate portion 133 on the YZ plane is defined as an upper side opening angle θsp.

<Operation of Working Equipment>

Figure 4:
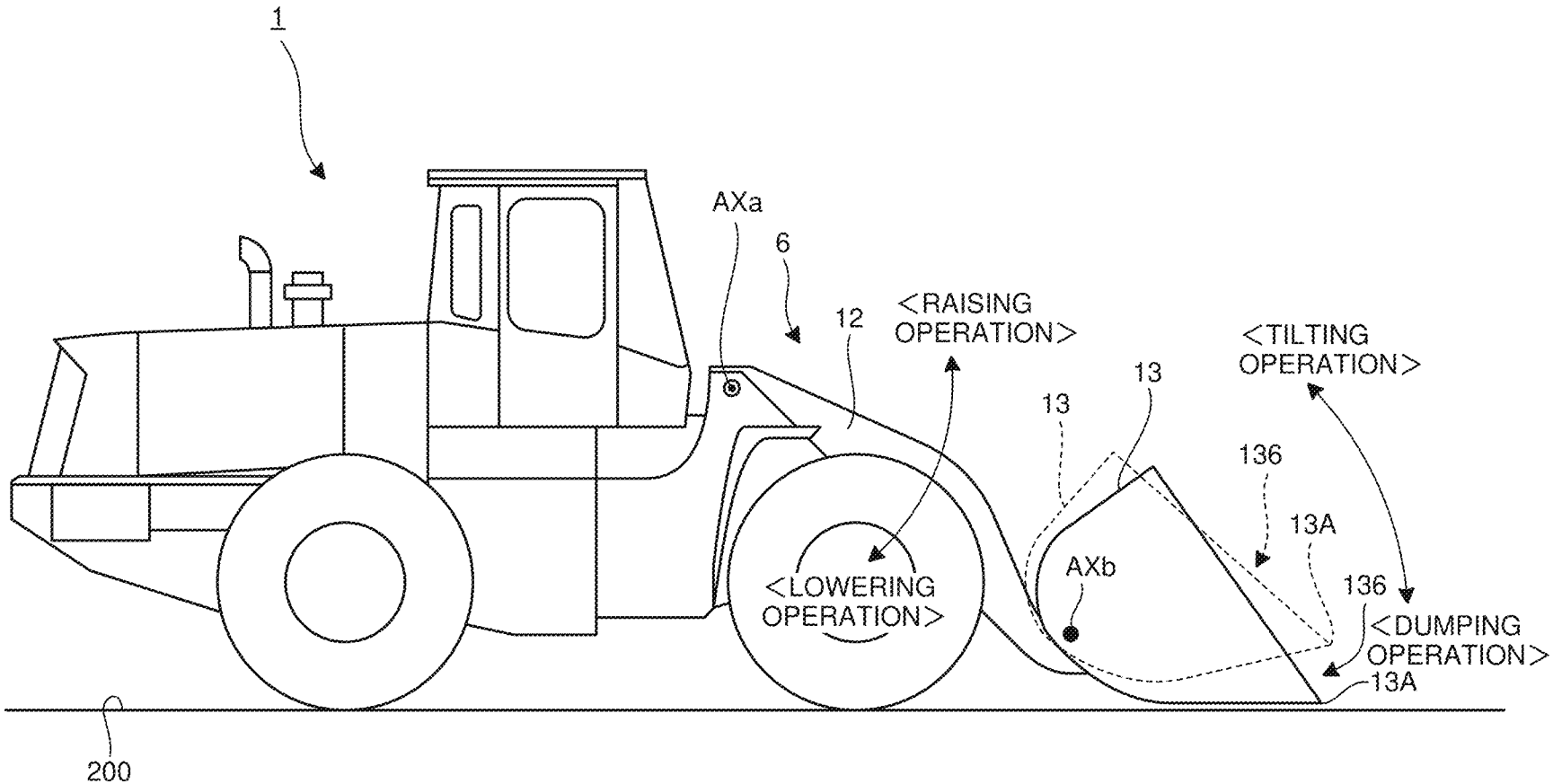
FIG. 4 is a diagram for describing an operation of working equipment according to the embodiment.

FIG. 4 is a diagram for describing an operation of the working equipment 6 according to the embodiment. In the embodiment, the working equipment 6 is front-loading type working equipment in which the opening portion 136 of the bucket 13 faces forward in an excavation work. When the lift cylinder 18 extends and contracts, the boom 12 performs a raising operation or a lowering operation. When the bucket cylinder 19 extends and contracts, the bucket 13 performs a tilting operation or a dumping operation.

The raising operation of the boom 12 is an operation in which the boom 12 pivots about the pivot axis AXa in such a way that the distal end portion of the boom 12 is separated from the ground surface 200. In the present embodiment, when the lift cylinder 18 extends, the boom 12 performs the raising operation.

The lowering operation of the boom 12 is an operation in which the boom 12 pivots about the pivot axis AXa in such a way that the distal end portion of the boom 12 approaches the ground surface 200. In the present embodiment, when the lift cylinder 18 contracts, the boom 12 performs the lowering operation.

The tilting operation of the bucket 13 is an operation in which the bucket 13 pivots about the pivot axis AXb in such a way that the blade end portion 13A is separated from the ground surface 200 in a state where the opening portion 136 of the bucket 13 faces upward. When the bucket cylinder 19 extends, the bell crank 14 pivots in such a way that the upper end portion of the bell crank 14 moves forward and the lower end portion of the bell crank 14 moves rearward. When the lower end portion of the bell crank 14 moves rearward, the bucket 13 is pulled rearward by the bucket link 15 and performs the tilting operation. By causing the bucket 13 to perform the tilting operation in this manner, the excavation target is scooped by the bucket 13, and the excavation target is held by the bucket 13.

The dumping operation of the bucket 13 is an operation in which the bucket 13 pivots about the pivot axis AXb in such a way that the blade end portion 13A approaches the ground surface 200 in a state where the opening portion 136 of the bucket 13 faces downward. When the bucket cylinder 19 contracts, the bell crank 14 pivots in such a way that the upper end portion of the bell crank 14 moves rearward and the lower end portion of the bell crank 14 moves forward. When the lower end portion of the bell crank 14 moves forward, the bucket 13 is pushed forward by the bucket link 15 and performs the dumping operation. By causing the bucket 13 to perform the dumping operation in this manner, the excavation target held by the bucket 13 is discharged from the bucket 13.

<Operation of Wheel Loader>

Figure 5:
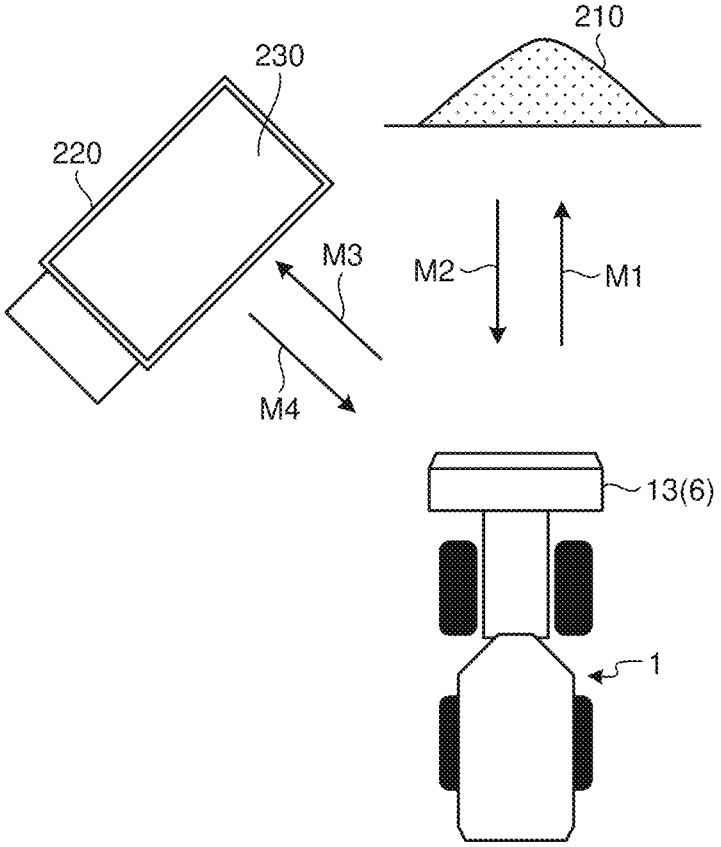
FIG. 5 is a diagram for describing an operation of the loading machine according to the embodiment.

FIG. 5 is a diagram for describing an operation of the wheel loader 1 according to the embodiment. The wheel loader 1 performs a predetermined work on a work target at a work site. The work target includes an excavation target and a loading target. The excavation target is, for example, at least one of a head of earth, a head of rocks, coal, feed, or a wall. The heap of earth is a heap of earth and sand, and the heap of rocks is a heap of rocks or stones. In the present embodiment, the excavation target is a head 210 of earth on the ground surface. The loading target is, for example, at least one of a haul vehicle, a predetermined area of the work site, a hopper, a belt conveyor, or a crusher. In the present embodiment, the loading target is a dump body 230 of a haul vehicle 220 capable of traveling on the ground surface. The haul vehicle 220 is, for example, a dump truck. The predetermined work includes an excavation work and a loading work. The wheel loader 1 performs an excavation work of excavating the excavation target with the bucket 13 of the working equipment 6. The wheel loader 1 performs a loading work of loading an excavated object excavated by the bucket 13 by an excavation work onto the loading target. The loading work is a concept including a discharge work of discharging an excavated object.

In the excavation work, the wheel loader 1 moves forward toward the head 210 of earth as indicated by an arrow M1 in FIG. 5 in a state where the excavated object is not held by the bucket 13. An operator moves the wheel loader 1 forward in such a way as to approach the head 210 of earth. In order to hold the excavated object in the bucket 13, the wheel loader 1 performs the excavation work by causing the bucket 13 to perform the tilting operation in a state where the bucket 13 enters the head 210 of earth. The operator operates the working equipment 6 in such a way that the head 210 of earth is excavated by the bucket 13. The head 210 of earth is excavated by the bucket 13, and the excavated object is scooped up by the bucket 13.

Next, the wheel loader 1 moves rearward in such a way as to move away from the head 210 of earth as indicated by an arrow M2 in FIG. 5 in a state where the excavated object is held by the bucket 13. The operator moves the wheel loader 1 rearward in such a way as to move away from the head 210 of earth.

Next, the loading work is performed. In the loading work, the wheel loader 1 moves forward toward the haul vehicle 220 as indicated by an arrow M3 in FIG. 5 in a state where the excavated object is held by the bucket 13. The operator moves the wheel loader 1 forward in such a way as to approach the haul vehicle 220 while turning the wheel loader 1. In a state where the wheel loader 1 moves forward toward the haul vehicle 220, the wheel loader 1 causes the boom 12 to perform the raising operation in such a way that the bucket 13 is disposed above the dump body 230 of the haul vehicle 220. The operator operates the working equipment 6 in such a way that the boom 12 performs the raising operation. After the boom 12 performs the raising operation and the bucket 13 is disposed above the dump body 230 of the haul vehicle 220, the wheel loader 1 performs the loading work by causing the bucket 13 to perform the dumping operation in order to discharge the excavated object in the bucket 13. The operator operates the working equipment 6 in such a way that the bucket 13 performs the dumping motion. The excavated object is discharged from the bucket 13 caused to perform the dumping operation, and is loaded onto the dump body 230 of the haul vehicle 220.

After the excavated object is loaded onto the dump body 230 of the haul vehicle 220, the wheel loader 1 moves rearward in such a way as to move away from the haul vehicle 220 as indicated by an arrow M4 in FIG. 5 in a state where the excavated object is not held by the bucket 13. The operator moves the wheel loader 1 rearward in such a way as to move away from the haul vehicle 220 while turning the wheel loader 1.

The wheel loader 1 repeats the above operation until the dump body 230 of the haul vehicle 220 is fully loaded with the excavated object or until the excavation of the head 210 of earth is completed.

<Control System>

Figure 6:
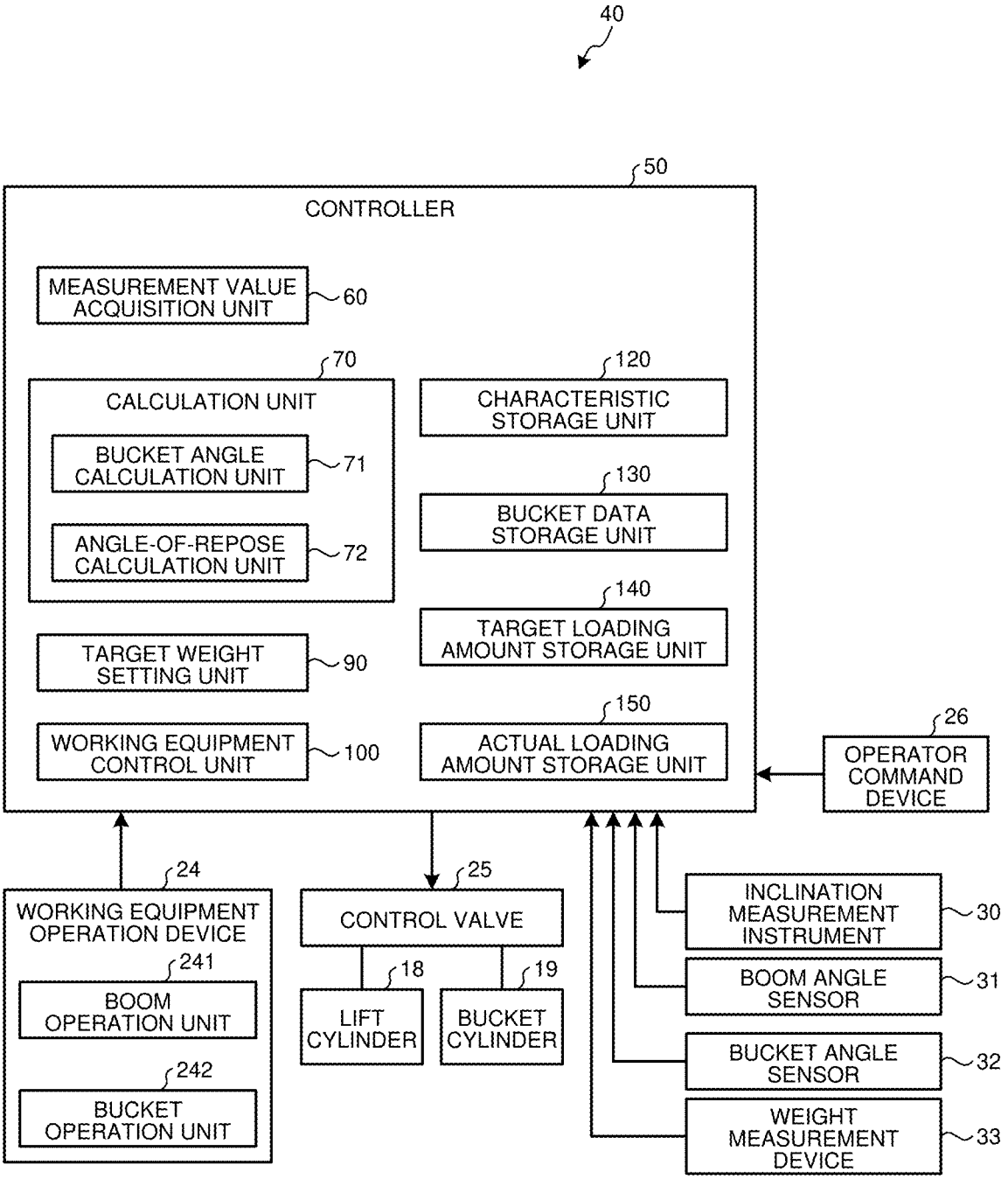
FIG. 6 is a functional block diagram illustrating a control system of the loading machine according to the embodiment.
Figure 7:
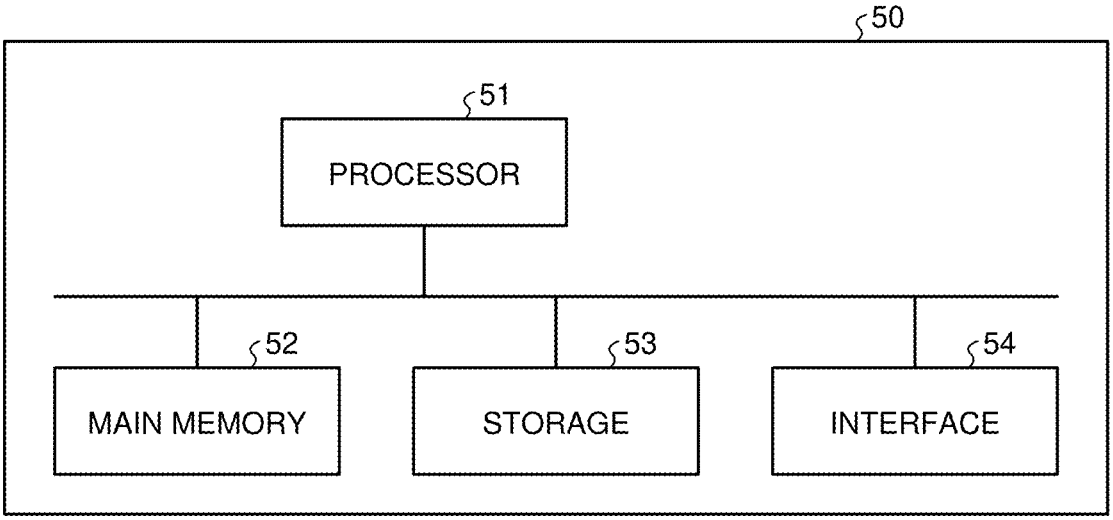
FIG. 7 is a block diagram illustrating a controller of the loading machine according to the embodiment.

FIG. 6 is a functional block diagram illustrating a control system 40 of the wheel loader 1 according to the embodiment. FIG. 7 is a block diagram illustrating a controller 50 of the wheel loader 1 according to the embodiment. The control system 40 performs various controls of the wheel loader 1. The control system 40 includes the working equipment operation device 24, a control valve 25, an operator command device 26, an inclination measurement instrument 30, a boom angle sensor 31, a bucket angle sensor 32, a weight measurement device 33, and the controller 50.

The working equipment operation device 24 is disposed inside the cab 4. The working equipment operation device 24 is operated by the operator. The working equipment operation device 24 generates an operation signal for operating the working equipment 6. The operator operates the working equipment operation device 24 to operate the working equipment 6. The working equipment operation device 24 includes, for example, a boom operation unit 241 and a bucket operation unit 242.

The boom operation unit 241 is operated by the operator to operate the boom 12. The controller 50 controls the control valve 25 based on an operation signal from the boom operation unit 241. As the control valve 25 is controlled, the lift cylinder 18 is driven and the boom 12 is operated.

The bucket operation unit 242 is operated by the operator to operate the bucket 13. The controller 50 controls the control valve 25 based on an operation signal generated by the bucket operation unit 242. As the control valve 25 is controlled, the bucket cylinder 19 is driven and the bucket 13 is operated.

The operator command device 26 is operated by the operator to start processing of calculating an angle θ of repose described below. The operator command device 26 is, for example, a switch provided in the working equipment operation device 24. The operator command device 26 outputs an operation command signal for starting the processing of calculating the angle θ of repose to the controller 50.

The inclination measurement instrument 30 measures an inclination of the vehicle body 2. More specifically, the inclination measurement instrument 30 measures a vehicle body inclination angle θa indicating the inclination of the vehicle body 2 with respect to a horizontal plane. The inclination measurement instrument 30 is disposed on at least a part of the vehicle body 2. The inclination measurement instrument 30 is, for example, an inertial measurement unit (IMU). The inclination measurement instrument 30 outputs vehicle body inclination angle data, which is a measurement value, to the controller 50.

The boom angle sensor 31 measures an angle of the boom 12. More specifically, the boom angle sensor 31 measures a boom angle θb indicating the angle of the boom 12 with respect to the vehicle body 2 in a local coordinate system. The boom angle sensor 31 is, for example, an angle sensor disposed at a connection portion between the vehicle body 2 and the boom 12. In the embodiment, the boom angle θb is an angle formed by a line connecting the pivot axis AXa and the pivot axis AXb and a line connecting the rotation axis CXf and the rotation axis CXr. The boom angle sensor 31 may be a stroke sensor that measures a stroke of the lift cylinder 18. The boom angle sensor 31 outputs boom angle data, which is a measurement value, to the controller 50.

The bucket angle sensor 32 measures an angle of the bucket 13. More specifically, the bucket angle sensor 32 measures a bell crank angle θc indicating an angle of the bell crank 14 with respect to the boom 12 in the local coordinate system. The bucket angle sensor 32 is, for example, an angle sensor disposed at a connection portion between the boom 12 and the bell crank 14. In the embodiment, the bell crank angle θc is an angle formed by a line connecting the pivot axis AXc and the pivot axis AXf and a line connecting the pivot axis AXa and the pivot axis AXb. The angle of the bucket 13 with respect to the boom 12 in the local coordinate system corresponds to the bell crank angle θc on a one-to-one basis. The angle of the bucket 13 with respect to the boom 12 in the local coordinate system is calculated by measuring the bell crank angle θc. The bucket angle sensor 32 may be a stroke sensor that measures a stroke of the bucket cylinder 19. The bucket angle sensor 32 outputs bell crank angle data, which is a measurement value, to the controller 50.

The weight measurement device 33 measures a weight Wa of an excavated object 300 held by the bucket 13. The weight measurement device 33 is, for example, a pressure sensor that measures a pressure of a hydraulic oil in the lift cylinder 18 or a pressure sensor that measures a pressure of a hydraulic oil in the bucket cylinder 19. A load applied to the working equipment 6 changes between a state where the excavated object 300 is held by the bucket and a state where the excavated object 300 is not held by the bucket 13. The weight measurement device 33 measures the weight Wa of the excavated object 300 held by the bucket 13 by measuring a change in load applied to the working equipment 6. The weight measurement device 33 may be a load gauge disposed on at least a part of the working equipment 6. The weight measurement device 33 may directly measure the weight Wa of the excavated object 300. The weight measurement device 33 outputs weight data of the excavated object 300, which is a measurement value, to the controller 50.

The controller 50 includes a computer system. The controller 50 outputs a control command for controlling the wheel loader 1. As illustrated in FIG. 7, the controller 50 includes a processor 51, a main memory 52, a storage 53, and an interface 54. The processor 51 executes a computer program to perform arithmetic processing of the operation of the working equipment 6. The processor 51 is, for example, a central processing unit (CPU) or a micro processing unit (MPU). The main memory 52 is, for example, a nonvolatile memory or a volatile memory. Examples of the nonvolatile memory include a read only memory (ROM). The volatile memory is a random access memory (RAM). The storage 53 is a non-transitory tangible storage medium. The storage 53 is, for example, a magnetic disk, a magneto-optical disk, a semiconductor memory, or the like. The storage 53 may be an internal medium directly connected to a bus of the controller 50 or an external medium connected to the controller 50 via the interface 54 or a communication line. The storage 53 stores a computer program for controlling the working equipment 6.

As illustrated in FIG. 6, the controller 50 includes a measurement value acquisition unit 60, a calculation unit 70, a target weight setting unit 90, a working equipment control unit 100, a characteristic storage unit 120, a bucket data storage unit 130, a target loading amount storage unit 140, and an actual loading amount storage unit 150. The controller 50 communicates with each of the working equipment operation device 24, the control valve 25, the inclination measurement instrument 30, the boom angle sensor 31, the bucket angle sensor 32, and the weight measurement device 33.

The measurement value acquisition unit 60 acquires measurement values from the inclination measurement instrument 30, the boom angle sensor 31, the bucket angle sensor 32, and the weight measurement device 33. The measurement value acquisition unit 60 acquires the vehicle body inclination angle θa from the inclination measurement instrument 30. The measurement value acquisition unit 60 acquires the boom angle θb from the boom angle sensor 31. The measurement value acquisition unit 60 acquires the bell crank angle θc from the bucket angle sensor 32. The measurement value acquisition unit 60 acquires the weight Wa of the excavated object 300 from the weight measurement device 33.

The calculation unit 70 calculates the angle θ of repose of the excavated object 300 held by the bucket 13. The calculation unit 70 calculates the angle θ of repose of the excavated object 300 held by the bucket 13 based on various measurement values acquired by the measurement value acquisition unit 60 and data stored in the characteristic storage unit 120. The calculation unit 70 includes a bucket angle calculation unit 71 and an angle-of-repose calculation unit 72.

The bucket angle calculation unit 71 calculates a bucket angle θbk indicating the angle of the bucket 13 with respect to the horizontal plane. The bucket angle calculation unit 71 calculates the bucket angle θbk based on the vehicle body inclination angle data, the boom angle data, and the bell crank angle data. The bucket angle calculation unit 71 calculates the bucket angle θbk based on the vehicle body inclination angle θa, the boom angle θb, and the bell crank angle θc.

The angle-of-repose calculation unit 72 calculates the angle θ of repose indicating an angle of the surface of the excavated object 300 with the blade end portion 13A as a starting point. The angle-of-repose calculation unit 72 calculates the angle of repose of the excavated object based on shape data of the bucket 13 stored in the bucket data storage unit 130, the bucket angle θbk calculated by the bucket angle calculation unit 71, and data of the excavated object including the measured weight. In the present embodiment, the angle-of-repose calculation unit 72 calculates the angle θ of repose based on the shape data of the bucket 13 stored in the bucket data storage unit 130, the bucket angle θbk calculated by the bucket angle calculation unit 71, and data of the excavated object 300 including the weight Wa of the excavated object 300 measured by the weight measurement device 33 and a density ρ of the excavated object 300 stored in the characteristic storage unit 120.

The target weight setting unit 90 sets a target weight Wr indicating a target value of the weight Wa of the excavated object 300 held by the bucket 13. A target loading amount Tr of the excavated object 300 for the dump body 230 is stored in the target loading amount storage unit 140. The target loading amount Tr is a unique value defined for the haul vehicle 220. The target weight setting unit 90 sets the target weight Wr based on the target loading amount Tr stored in the target loading amount storage unit 140.

The working equipment control unit 100 controls a posture of the bucket 13 in such a way that the weight of the excavated object 300 held by the bucket 13 becomes the target weight Wr. The posture of the bucket 13 includes the bucket angle θbk indicating the angle of the bucket 13 with respect to the horizontal plane. During the excavation work, the working equipment control unit 100 controls at least one of the lift cylinder 18 or the bucket cylinder 19 to adjust the bucket angle θbk.

The characteristic storage unit 120 stores characteristic data of the excavated object 300. The characteristic storage unit 120 stores the density p of the excavated object 300 in advance as the characteristic data. The characteristic storage unit 120 stores the angle θ of repose of the excavated object 300 calculated by the angle-of-repose calculation unit 72 as the characteristic data.

The bucket data storage unit 130 stores the shape data of the bucket 13. More specifically, the bucket data storage unit 130 stores specification data or design data of the bucket 13 including dimensions of the bucket 13. The bucket data storage unit 130 includes, for example, the cross-sectional area Abk, the length L, the width H, the blade side opening angle θap, and the upper side opening angle θsp of the bucket 13.

The target loading amount storage unit 140 stores the target loading amount Tr of the excavated object 300 with respect to the dump body 230.

The actual loading amount storage unit 150 stores an actual loading amount Tp indicating an actual loading amount of the excavated object 300 loaded on the dump body 230. The predetermined work including the excavation work and the loading work is performed on one haul vehicle 220 a plurality of times. A weight calculation unit 84 adds the weight Wp of the excavated object 300 calculated in each of the plurality of times of excavation work, and stores the actual loading amount Tp in the actual loading amount storage unit 150.

Figure 8:
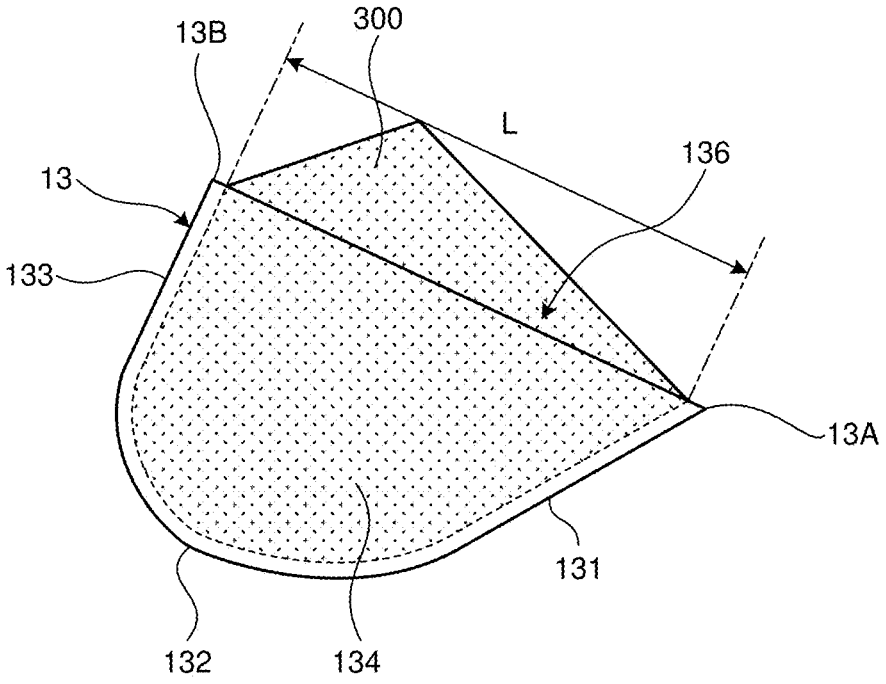
FIG. 8 is a diagram for describing a state of an excavated object held by the bucket according to the embodiment.
Figure 9:
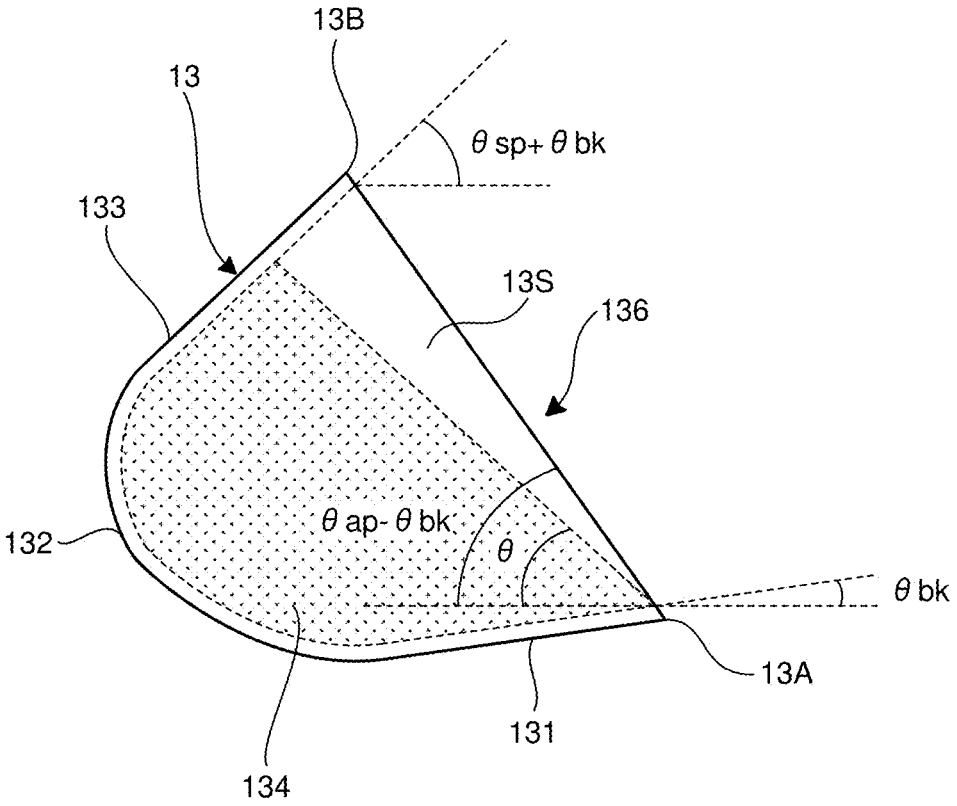
FIG. 9 is a diagram illustrating an angle of repose of the excavated object held by the bucket according to the embodiment.

FIG. 8 is a diagram illustrating a state of the excavated object 300 held by the bucket according to the embodiment. FIG. 9 is a diagram illustrating the angle of repose of the excavated object 300 held by the bucket according to the embodiment. Various controls of the wheel loader 1 are performed using an angle of repose (stop repose angle). The angle of repose is, for example, an angle that can be observed when the excavation target is stacked and a collapse of the excavation target naturally ends. That is, the angle of repose is an inclination angle at which the excavation target remains at a predetermined position without sliding with respect to the horizontal plane. In the embodiment, the control system 40 of the wheel loader 1 calculates the angle θ of repose of the excavated object 300 held by the bucket 13.

The angle θ of repose is an inclination of the surface of the excavated object 300 with respect to the horizontal plane. The angle θ of repose changes, for example, depending on a property of the excavation target affected by weather or the like. In a case where the property of the excavation target is constant, the angle θ of repose does not change even when the bucket angle θbk indicating the angle of the bucket 13 with respect to the horizontal plane changes. In a case where the property of the excavation target changes, the angle θ of repose changes. For example, when the weather changes from fine weather to rainy weather, the property of the excavation target changes, and the angle θ of repose changes.

As illustrated in FIG. 8, when the bucket 13 is inclined in a state where the bucket 13 is fully loaded with the excavated object 300, a part of the excavated object 300 is discharged from the bucket 13 due to the effect of gravity. When a part of the excavated object 300 is discharged from the bucket 13, the surface of the excavated object 300 forms an inclination with the blade end portion 13A as a starting point as illustrated in FIG. 9. The angle θ of repose is an angle of an inclination in which the surface of the excavated object 300 remains without sliding down with the blade end portion 13A as a starting point with respect to the horizontal plane. The angle θ of repose is an angle of an inclination formed by the surface of the excavated object 300 exposed in the opening portion 136 of the bucket 13 with the blade end portion 13A as a starting point with respect to the horizontal plane.

A method for calculating the angle θ of repose will be described in detail. After the bucket 13 is fully loaded with the excavated object 300, a part of the excavated object 300 held by the bucket 13 is discharged as illustrated in FIG. 9. When a part of the excavated object 300 held by the bucket 13 is discharged, a state where the inclination in which the surface of the excavated object 300 remains without sliding down is maintained, in other words, a state where the inclination of the surface of the excavated object 300 held by the bucket 13 is maintained on the YZ plane. A cross-sectional area A of the excavated object 300 in this state is calculated from the cross-sectional area Abk of the bucket 13 stored in the bucket data storage unit 130 and a cross-sectional area As of a gap 13S of the bucket 13 based on the following Equation (1).

$$A = Abk - As \tag{1}$$

In a state where the angle of the surface of the excavated object 300 held by the bucket 13 on the YZ plane is the angle of repose, a volume V of the excavated object 300 is calculated from the cross-sectional area A of the excavated object 300 and the width H of the opening portion 136 stored in the bucket data storage unit 130 based on the following Equation (2).

$$V=A\times H \tag{2}$$

The volume V of the excavated object 300 is calculated from Equations (1) and (2) based on the following Equation (3) using the length L, the width H, and the blade side opening angle θap of the bucket 13, and the upper side opening angle θsp of the bucket 13 when the bucket 13 is made horizontal (hereinafter, referred to as "when the bucket is horizontal") stored in the bucket data storage unit 130.

$$V = \left(Abk - \text{abs}\left(\frac{L^2 \times \sin(\theta sp + \theta ap) \times \sin(\theta - \theta ap + \theta bk)}{2\sin(\theta sp + \theta bk + \theta)}\right)\right) \times H \quad (3)$$

The volume V of the excavated object 300 is calculated based on the following Equation (4) using the weight Wa of the excavated object 300 held by the bucket 13 measured by the weight measurement device 33 and the density p of the excavated object 300 stored in the characteristic storage unit 120.

$$V = Wa/\rho \quad (4)$$

The following Equation (5) is established from Equations (3) and (4). The angle θ of repose is calculated from Equation (5).

$$\left(Abk - \text{abs}\left(\frac{L^2 \times \sin(\theta sp + \theta ap) \times \sin(\theta - \theta ap + \theta bk)}{2\sin(\theta sp + \theta bk + \theta)}\right)\right) \times H = Wa/\rho \quad (5)$$

<Method for Calculating Angle of Repose>

Figure 10:
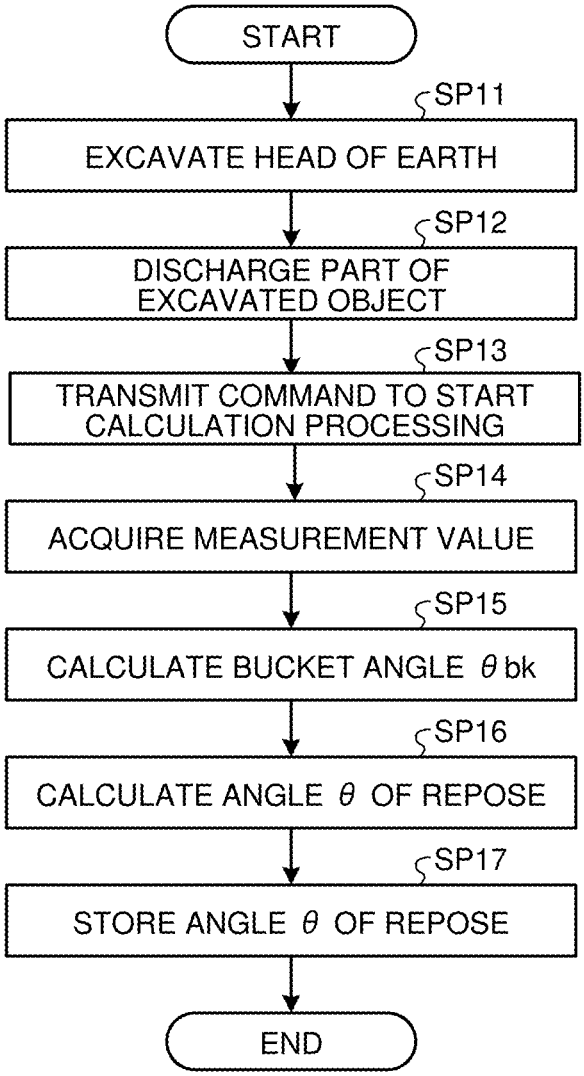
FIG. 10 is a flowchart illustrating a method for calculating an angle of repose according to the embodiment.

FIG. 10 is a flowchart illustrating a method for calculating the angle of repose according to the embodiment. The operator causes the controller 50 to start processing of calculating the angle θ of repose before the first excavation work for the head 210 of earth.

The operator excavates the head 210 of earth with the bucket 13 and holds the excavated object 300 (step SP11). More specifically, as illustrated in FIG. 8, after excavating the head 210 of earth in such a way that the inside of the bucket 13 is fully loaded with the excavated object 300, the operator causes the bucket 13 to perform the tilting operation in such a way that the excavated object 300 is held in the bucket 13.

Next, the operator discharges a part of the excavated object 300 in the bucket 13 (step SP12). More specifically, the operator causes the bucket 13 to perform the dumping operation to such an extent that the excavated object 300 is not completely discharged from the bucket 13 in a state where the bucket 13 is fully loaded with the excavated object 300. For example, the operator causes the bucket 13 to perform the dumping operation between a tilting operation position in step SP11 and a position with the bucket angle θbk of larger than 0°. When a part of the excavated object 300 is discharged from the bucket 13, the surface of the excavated object 300 held in the bucket 13 maintains the inclination in which the surface of the excavated object 300 remains at a predetermined position without sliding down with the blade end portion 13A as a starting point as illustrated in FIG. 9. The angle of the surface of the excavated object 300 in the bucket 13 maintains the angle of repose.

Next, in the state of step SP12, the operator transmits, to the controller 50, a command to start processing of calculating the angle θ of repose (step SP13). More specifically, when the operator operates the operator command device 26, the operator command device 26 outputs, to the controller 50, an operation command signal to start processing of calculating the angle θ of repose.

The controller 50 acquires measurement values from a plurality of sensors (step SP14). More specifically, the measurement value acquisition unit 60 acquires the vehicle body inclination angle θa, the boom angle θb, the bell crank angle θc, and the weight Wa of the excavated object 300 in a state where the surface of the excavated object 300 held by the bucket 13 on the YZ plane maintains the angle of repose.

The controller 50 calculates the bucket angle θbk (step SP15). More specifically, the bucket angle calculation unit 71 calculates the bucket angle θbk based on the vehicle body inclination angle θa, the boom angle θb, and the bell crank angle θc acquired by the measurement value acquisition unit 60.

The controller 50 calculates the angle θ of repose (step SP16). More specifically, the angle-of-repose calculation unit 72 calculates the angle θ of repose based on detection data of the angle of the vehicle body 2, the specification data or design data of the bucket 13 stored in the bucket data storage unit 130, the weight Wa of the excavated object 300 acquired in step SP14, and the bucket angle θbk calculated in step SP15.

The controller 50 stores the angle θ of repose (step SP17). More specifically, the characteristic storage unit 120 stores the angle θ of repose calculated by the angle-of-repose calculation unit 72.

Various controls of the wheel loader 1 are performed using the angle θ of repose calculated in this manner.

<Effects>

As described above, in the embodiment, the angle θ of repose of the excavated object 300 can be calculated from the shape data of the bucket 13 stored in the bucket data storage unit 130, the bucket angle θbk, and the data of the excavated object 300 including the weight W of the excavated object 300 measured by the weight measurement device 33 and the density ρ of the excavated object 300 stored in the characteristic storage unit 120. In the embodiment, it is possible to calculate the angle θ of repose without providing a sensor other than a sensor installed for performing a predetermined work by the wheel loader 1.

In the embodiment, the shape data of the bucket 13 includes the length L, the width H, the blade side opening angle θap, and the upper side opening angle θsp of the bucket 13. According to the embodiment, the angle θ of repose can be calculated using the specification data or design data of the bucket 13. In the embodiment, the angle θ of repose can be calculated using the shape data of the bucket 13 stored in order to perform a predetermined work by the wheel loader 1.

In the embodiment, the bucket angle θbk can be calculated based on the detection data of the angle of the vehicle body 2 of the wheel loader 1 that supports the working equipment 6 and detection data of an angle of the working equipment 6.

In the embodiment, after the bucket 13 is fully loaded with the excavated object 300, a part of the excavated object 300 is discharged, so that the inclination of the surface of the excavated object 300 held by the bucket 13 is maintained. In the embodiment, the surface of the excavated object 300 can have the angle of repose by an operation normally performed by the wheel loader 1. According to the embodiment, it is possible to easily calculate the angle θ of repose without causing the wheel loader 1 to perform an operation different from a normal operation.

First Modified Example

Figure 11:
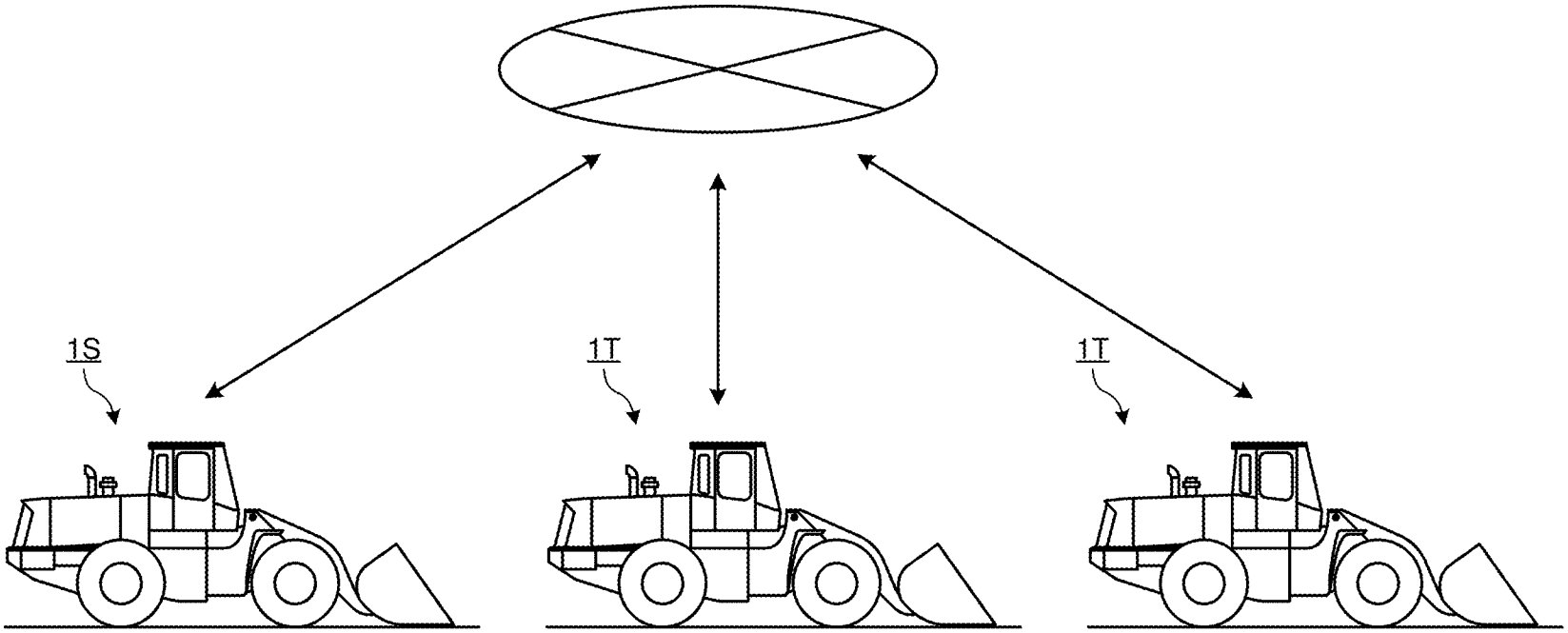
FIG. 11 is a schematic diagram illustrating another example of the loading machine.

FIG. 11 is a schematic diagram illustrating another example of the loading machine. In a case where a plurality of loading machines perform a work at the same work site, the angle θ of repose may be calculated by a first loading machine 1S as a master machine, and the calculated angle θ of repose may be transmitted to a second loading machine 1T as a slave machine via a communication system. Examples of the communication system include the Internet, a local area network (LAN), a mobile phone communication network, and a satellite communication network.

Second Modified Example

In FIG. 10, the order of step SP12 and step SP13 may be reversed. After step SP11, the operator transmits, to the controller 50, a command to start processing of calculating the angle θ of repose. Thereafter, the wheel loader 1 may automatically discharge a part of the excavated object 300 in the bucket 13.

OTHER EMBODIMENTS

In the above-described embodiment, steps SP11 and SP12 of the flowchart illustrated in FIG. 10 may be autonomously performed by the loading machine 1 without an operation by the operator.

The operator command device 26 according to the above-described embodiment is a switch, but is not limited thereto. The operator command device 26 may be, for example, a touch screen or a microphone. The touch screen includes a display and a touch panel. The operator may operate the touch screen to output a command to start processing of calculating the angle θ of repose to the controller 50. Alternatively, a command to start processing of calculating the angle θ of repose may be output to the controller 50 based on a speech input via the microphone.

In addition, although the loading machine 1 according to the above-described embodiment has been described as being operated by the operator, the present disclosure is not limited thereto. The loading machine 1 may be operated by a remote system. In this case, for example, a device having a function of the controller 50 and including a remote operation device is provided at a remote operation place. The angle θ of repose may be calculated remotely.

In the above-described embodiment, the loading machine 1 is a wheel loader, but the loading machine 1 is not limited thereto. For example, the loading machine 1 may be an excavator including loading type working equipment. In addition, the loading machine 1 may be an excavator including backhoe-type working equipment in which the opening portion 136 of the bucket 13 faces rearward in the excavation work.

REFERENCE SIGNS LIST

1 WHEEL LOADER (LOADING MACHINE)
2 VEHICLE BODY
4 CAB
5 WHEEL
5F FRONT WHEEL
5R REAR WHEEL
6 WORKING EQUIPMENT
12 BOOM
13 BUCKET
13A BLADE END PORTION
13B UPPER END PORTION
13C RIGHT END PORTION
13D LEFT END PORTION
14 BELL CRANK
15 BUCKET LINK
16 BRACKET
17 BRACKET
18 LIFT CYLINDER
19 BUCKET CYLINDER
20 POWER SOURCE
21 PTO
22 POWER TRANSMISSION DEVICE
23 HYDRAULIC PUMP
24 WORKING EQUIPMENT OPERATION DEVICE
241 BOOM OPERATION UNIT
242 BUCKET OPERATION UNIT
25 CONTROL VALVE
26 OPERATOR COMMAND DEVICE
30 INCLINATION MEASUREMENT INSTRUMENT
31 BOOM ANGLE SENSOR
32 BUCKET ANGLE SENSOR
33 WEIGHT MEASUREMENT DEVICE
40 CONTROL SYSTEM
50 CONTROLLER
51 PROCESSOR
52 MAIN MEMORY
53 STORAGE
54 INTERFACE
70 CALCULATION UNIT
71 BUCKET ANGLE CALCULATION UNIT
72 ANGLE-OF-REPOSE CALCULATION UNIT
90 TARGET WEIGHT SETTING UNIT
100 WORKING EQUIPMENT CONTROL UNIT
120 CHARACTERISTIC STORAGE UNIT
130 BUCKET DATA STORAGE UNIT
131 BOTTOM PLATE PORTION
132 BACK PLATE PORTION
133 UPPER PLATE PORTION
134 RIGHT PLATE PORTION
135 LEFT PLATE PORTION
136 OPENING PORTION
140 TARGET LOADING AMOUNT STORAGE UNIT
150 ACTUAL LOADING AMOUNT STORAGE UNIT
200 GROUND SURFACE
210 HEAD OF EARTH (EXCAVATION TARGET)
220 HAUL VEHICLE
230 DUMP BODY (LOADING TARGET)
300 EXCAVATED OBJECT
A CROSS-SECTIONAL AREA OF EXCAVATED OBJECT
Abk CROSS-SECTIONAL AREA OF BUCKET
As CROSS-SECTIONAL AREA OF GAP
AXa PIVOT AXIS
AXb PIVOT AXIS
AXc PIVOT AXIS
AXd PIVOT AXIS
AXe PIVOT AXIS
AXf PIVOT AXIS
CXf ROTATION AXIS
CXr ROTATION AXIS
H WIDTH
L LENGTH
Tp ACTUAL LOADING AMOUNT
Tr TARGET LOADING AMOUNT
V VOLUME OF EXCAVATED OBJECT
Wa WEIGHT
Wr TARGET WEIGHT
θ ANGLE OF REPOSE
θa VEHICLE BODY INCLINATION ANGLE
θb BOOM ANGLE
θap BLADE SIDE OPENING ANGLE

θbk BUCKET ANGLE
θc BELL CRANK ANGLE
θsp UPPER SIDE OPENING ANGLE
ρ DENSITY

The invention claimed is:

1. A method for calculating an angle of repose of an excavated object held by a bucket, the method comprising:

calculating a bucket angle indicating an angle of the bucket with respect to a horizontal plane in a state where an inclination of a surface of the excavated object held by the bucket is maintained;

measuring a weight of the excavated object; and calculating the angle of repose of the excavated object from shape data of the bucket, the bucket angle, and data of the excavated object including the measured weight; and discharging a part of the excavated object held by the bucket after the bucket is fully loaded with the excavated object to maintain the inclination of the surface of the excavated object.

2. The method according to claim 1, wherein the bucket includes a blade end portion, an upper end portion facing the blade end portion, and an opening portion defined between the blade end portion and the upper end portion, and the angle of repose is an angle of the inclination of the surface of the excavated object exposed in the opening portion with the blade end portion as a starting point.

3. The method according to claim 1, wherein the angle of the bucket is calculated based on detection data of an angle indicating an inclination of a vehicle body supporting working equipment and detection data of an angle of the working equipment.

4. The method according to claim 1, wherein the data of the excavated object includes a density of the excavated object.

5. A system for calculating an angle of repose of an excavated object held by a bucket, the system comprising:

a processor, wherein the processor calculates a bucket angle indicating an angle of the bucket with respect to a horizontal plane in a state where an inclination of a surface of the excavated object held by the bucket is maintained, measures a weight of the excavated object, and calculates the angle of repose of the excavated object from shape data of the bucket, the bucket angle, and data of the excavated object including the measured weight, and discharges a part of the excavated object held by the bucket after the bucket is fully loaded with the excavated object to maintain the inclination of the surface of the excavated object.

6. A loading machine comprising:

the system according to claim 5;

providing the bucket.

7. A system for calculating an angle of repose of an excavated object held by a bucket, the system comprising: a processor, wherein the processor:

calculates a bucket angle indicating an angle of the bucket with respect to a horizontal plane in a state where an inclination of a surface of the excavated object held by the bucket is maintained;

measures a weight of the excavated object, calculates the angle of repose of the excavated object from shape data of the bucket, the bucket angle, and data of the excavated object including the measured weight;

calculates the angle of the bucket based on detection data of an angle indicating an inclination of a vehicle body supporting working equipment and detection data of an angle of the working equipment, and stores the calculated angle of repose; and uses the stored angle of repose for setting a target weight of the excavated object to be held by the bucket in a subsequent excavation work.

8. The system according to claim 7, wherein the weight of the excavated object is determined from a change in load applied to the working equipment based on a pressure of a hydraulic oil measured by a pressure sensor.

* * * * *